US012152853B1

(12) United States Patent
Bray

(10) Patent No.: US 12,152,853 B1
(45) Date of Patent: Nov. 26, 2024

(54) SCOPE MOUNT

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 18/396,600

(22) Filed: Dec. 26, 2023

Related U.S. Application Data

(60) Provisional application No. 63/540,365, filed on Sep. 25, 2023.

(51) Int. Cl.
*F41A 25/16* (2006.01)
*F41G 11/00* (2006.01)

(52) U.S. Cl.
CPC ..... *F41A 25/16* (2013.01); *F41G 11/003* (2013.01)

(58) Field of Classification Search
CPC ..... F41G 11/001; F41G 11/003; F41G 11/004
USPC ..... 42/124
See application file for complete search history.

(56) References Cited

U.S. PATENT DOCUMENTS 6,874,269 B2 * 4/2005 Chen ..... F41G 11/003 42/106
8,112,993 B2 2/2012 Hummel et al.
8,276,307 B2 10/2012 Deros
8,667,727 B2 3/2014 Engelhardt
9,441,915 B2 9/2016 Zimmer
D768,257 S 10/2016 Boyd et al.
10,024,632 B1 7/2018 Oglesby
10,036,614 B1 7/2018 Ruiz
10,048,040 B1 * 8/2018 Ratliff ..... F41G 11/001
10,359,258 B2 7/2019 Geissele
10,788,292 B2 9/2020 Alldredge et al.
10,845,162 B2 11/2020 Geissele
11,585,620 B2 2/2023 Raley et al.
2005/0257415 A1 * 11/2005 Solinsky ..... F41G 11/003 42/114
2011/0023348 A1 * 2/2011 Karagias ..... F41G 11/003 42/124
2012/0291331 A1 * 11/2012 Troy ..... F41G 11/003 42/124
2013/0000176 A1 * 1/2013 Goertzen ..... F41G 11/003 42/90
2013/0133238 A1 * 5/2013 Quetschke ..... F41G 11/003 29/428
2014/0047754 A1 * 2/2014 Compton ..... F41G 11/00 42/84

(Continued)

FOREIGN PATENT DOCUMENTS

CN 201122078 Y * 9/2008

*Primary Examiner* — Bret Hayes
(74) *Attorney, Agent, or Firm* — Kunzler Bean & Adamson

(57) ABSTRACT

Disclosed is a base for attaching a scope mounting system to a firearm rail. The base includes a first dovetail slot extending from a first end of the base to a first ring abutment, and a second dovetail slot extending from a second end of the base to a second ring abutment. The base also includes a wedge mechanism coupled to the base and configured to engage side surfaces of a groove formed in the firearm rail. A scope mounting system also is disclosed and includes the base and one or more scope mount rings.

20 Claims, 11 Drawing Sheets

(56) References Cited

U.S. PATENT DOCUMENTS

| | | | | |
|---|---|---|---|---|
| 2014/0259854 | A1* | 9/2014 | Williams | F41G 11/003 42/124 |
| 2015/0316355 | A1* | 11/2015 | Boswell | F41G 11/004 42/146 |
| 2017/0241735 | A1* | 8/2017 | Burge | F41G 11/003 |
| 2017/0254615 | A1* | 9/2017 | Kennair, Jr. | F41G 11/003 |
| 2018/0340754 | A1 | 11/2018 | Cosentino | |
| 2021/0293512 | A1 | 9/2021 | Duncan, III | |
| 2022/0282956 | A1 | 9/2022 | Yan | |
| 2022/0333900 | A1 | 10/2022 | Beasley | |
| 2023/0135474 | A1 | 5/2023 | Fackler et al. | |
| 2023/0228533 | A1 | 7/2023 | Gerber et al. | |
| 2024/0255258 | A1* | 8/2024 | Seekins | F41G 11/004 |

* cited by examiner

SCOPE MOUNT

CROSS-REFERENCES TO RELATED APPLICATIONS

This application claims the benefit of U.S. Provisional Patent Application No. 63/540,365 entitled "SCOPE MOUNT" and filed on Sep. 25, 2023, for Ernest R. Bray, which is incorporated herein by reference.

FIELD

This disclosure relates generally to firearms, and more particularly to mechanisms for mounting scopes to firearms.

BACKGROUND

Firearms typically have a platform for allowing the coupling of different types of accessories, including but not limited to, sighting optics. A common platform for the coupling of accessories is known as the Picatinny rail system. Magnified sighting optics, also known as scopes, coupled to the Picatinny rail allow for accurate shots from long distances. However, many current scope mounting devices are problematic in that they utilize many screws that are difficult to properly torque. Also, many scope mounting devices do not properly engage with the Picatinny rail in that they allow forward and rearward movement with reference to the firearm and they may engage the edges of the rail instead of the underside angle. Additionally, many quick-disconnect systems, that utilize a lever, continually snag the lever on gear and potentially damage the Picatinny rail or even the firearm receiver itself.

SUMMARY

Disclosed is a base for attaching a scope mounting system to a firearm rail. The base includes a first dovetail slot extending from a first end of the base to a first ring abutment, and a second dovetail slot extending from a second end of the base to a second ring abutment. The base also includes a wedge mechanism coupled to the base and configured to engage side surfaces of a groove formed in the firearm rail. A scope mounting system and method are also disclosed that include the base.

In certain examples, the base includes a first scope ring configured to couple a scope to the base, where the front scope ring includes at least one sloped surface configured to engage the first dovetail slot. The first scope ring includes a first half and a second half and the first half is pivotally coupled with the second half at a top hinge, in certain examples.

The scope ring may include at least one accessory mounting surface. In certain examples, the base includes a second scope ring that is configured to couple the scope to the base, where the second scope ring includes at least one sloped surface configured to engage the second dovetail slot. Also included is a fastener configured to pass through an opening in the side surface of the base and engage a vertical surface formed in the sloped surface.

The base, in certain examples, includes a side surface configured to engage a first undercut surface of the rail system. The base may also include a locking bar disposed opposite the side surface and configured to engage a second undercut surface of the rail system.

In certain examples, the wedge mechanism includes a wedge receiver, a wedge coupled to the side surface, and a wedge fastener. The wedge fastener is configured to pass through the locking bar and the wedge receiver and into an opening in the wedge. Tightening the wedge fastener causes the wedge to be drawn into and spread open the wedge receiver.

The base, in certain examples, includes at least one fastening dial configured to secure the locking bar to the base. The at least one fastening dial comprises a ball detent for indicating a plurality of tightening positions.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
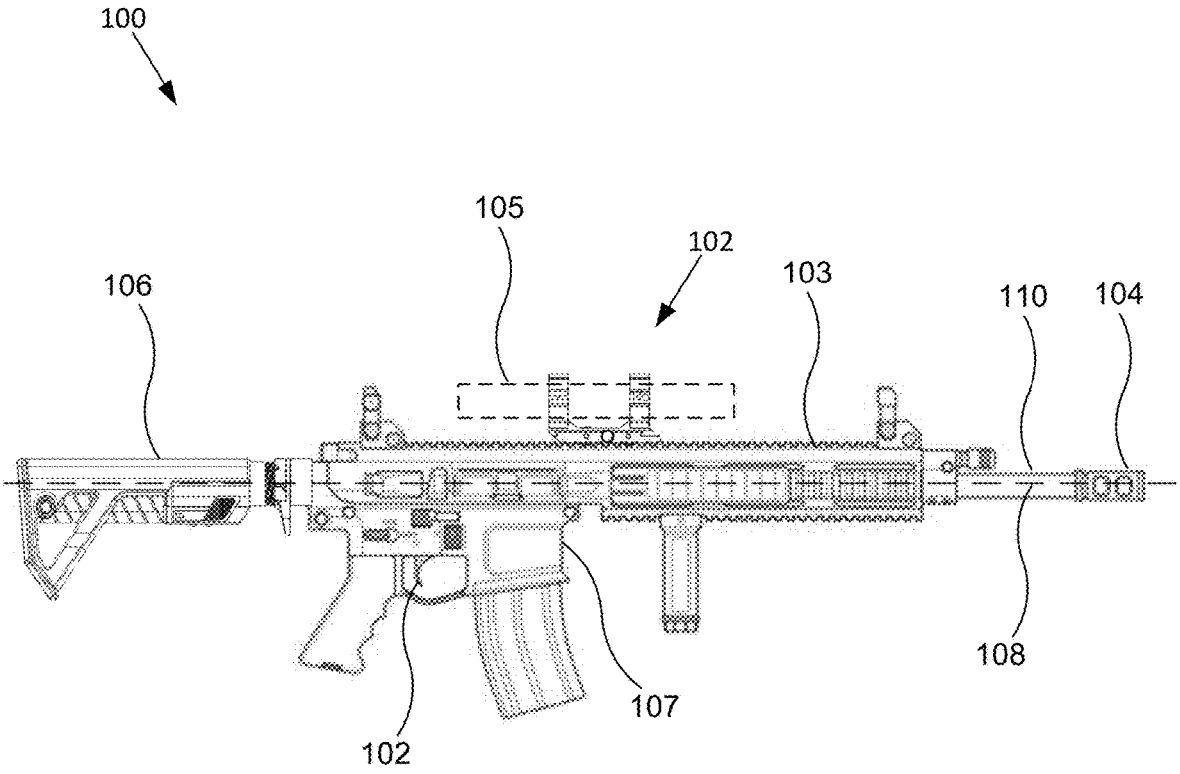
FIG. 1 is a side view diagram illustrating one embodiment of a firearm including an improved scope mounting system in accordance with embodiments of the present disclosure.

FIG. 1 is a side view diagram illustrating one embodiment of a firearm 100 including an improved scope mounting system 102 in accordance with embodiments of the present disclosure. The scope mounting system 102, in the depicted embodiment, may be used with any firearm that utilizes a rail integration system to mount a scope 105 to the firearm 100. Examples of rail integration systems include, but are not limited to, Picatinny rails, Weaver rails, NATO accessory rail, etc. Although the examples of the current disclosure describe a Picatinny style mounting rail 103, it is contemplated that other dovetail-style rails may be implemented and adapted for use with the scope mounting system 102. As known to those of skill in the art, the rail 103 is formed with a strip undercut to form a flattened T with a hexagonal top cross-section (see FIG. 8). Cross-slots are formed in the rail 103 at regular intervals to allow for the positioning of accessories, such as the scope mounting system 102.

The depicted embodiment illustrates a firearm of the M16 family of firearms including, but not limited to, all AR variants, the M16 firearm, the M4 firearm, and others which use a bolt carrier. However, as discussed above, the scope mounting system 102 may be used with any firearm having a rail accessory strip. The AR variant depicted here is given by way of example only, and is not intended to be limiting. As used herein, the terms "forward" and "front" refer to ends of mechanisms that are nearest the muzzle end 104 of the firearm 100. Similarly, "rear," or "rearward," correspond to ends of mechanisms that are furthest from the muzzle end 104 of the firearm (i.e., towards the stock 106). However, it is contemplated that the features of the current disclosure are equally applicable to other types of firearms.

As will be discussed in greater detail below, the present disclosure provides a scope mounting system 102 having hinged scope rings and a wedge mechanism for securing the scope mounting system 102 to the rail 103.

Figure 2:
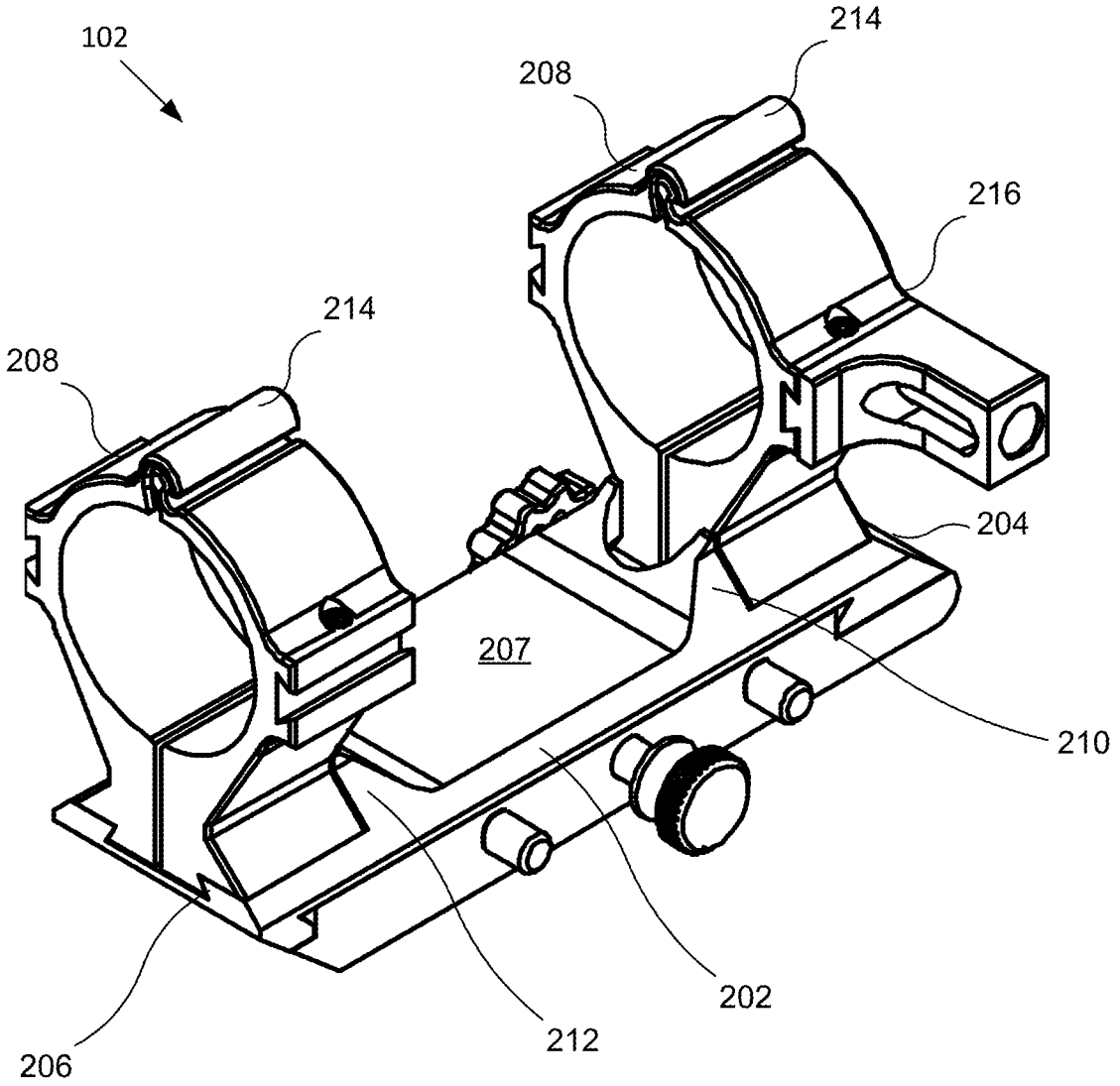
FIG. 2 is a perspective view diagram illustrating one example of the scope mounting system in accordance with the current disclosure.

FIG. 2 is a perspective view diagram illustrating one example of the scope mounting system 102 in accordance with the current disclosure. The scope mounting system 102 includes a base 202 configured to engage with the rail 103. The base 202 may be formed of a rigid metal or composite metal material. The base 202, in certain examples, is elongated and dimensioned to engage the rail 103. The base 202, as will be described in greater detail below with reference to FIG. 3, includes a forward dovetail slot 204 and a rearward dovetail slot 206. Each of the forward dovetail slot and the rearward dovetail slot are configured to receive a dovetail of a hinged scope ring 208. The term dovetail refers to a trapezoidal shape (i.e., the "tail") that is configured to interlock with a corresponding slot or opening with a resistance to being pulled apart. Other shapes, for example a T-slot, that achieve a high tensile strength are also contemplated.

Each of the forward dovetail slot 204 and the rearward dovetail slot 206 are formed in a top surface 207 of the base 202 and are oriented, generally, parallel to the bore of the barrel of the firearm. Stated differently, when attaching a hinged scope ring 208 to the base 202, the hinged scope rings 208 slide in a direction that is parallel to the bore axis 108. The forward dovetail slot 204, as will be described in greater detail below, extends from a forward end of the base 202 towards a front ring abutment 210. The front ring abutment 210 includes at least one substantially vertical face for engaging a surface of one of the hinged scope rings 208. The front ring abutment 210 beneficially prevents rearward movement of the forward hinged scope ring 208 during heavy recoil.

Likewise, the rearward dovetail slot 206 extends from a rearward end of the base 202 towards a rear ring abutment 212. The rear ring abutment 212 includes at least one substantially vertical face for engaging a surface of rear hinged scope ring 208. The rear ring abutment 212 beneficially prevents forward movement of the rear hinged scope ring 208 during heavy recoil. It is contemplated that either the front or rear ring abutment may have engaging surfaces that are non-orthogonal to the base and the hinged scope rings may be configured with a corresponding angled surface. In other words, the substantially vertical faces may be replaced with non-vertical faces.

Each hinged scope ring 208 is configured to engage a portion of the scope 105. The hinged scope ring 208, as will be described below in greater detail, is formed of a first half and a second half that hinge together, in certain examples, at a top hinge 214. The top hinge 214 design, together with a bottom dovetail interface, beneficially reduces the number of screws per scope 105 to two. In certain examples, these screws or fasteners are #10 set screws with a dog nose that interfaces with a socket in each hinged scope ring 208. This allows the fastener to bottom out and prevent over-tightening of the ring.

In certain examples, each of the forward hinged scope ring 208 and the rearward hinged scope ring 208 may be formed with accessory mounting interfaces 216. The accessory mounting interfaces 216 may include inverse dovetail slots for attaching the accessories, as depicted. Alternatively, the accessory mounting surfaces may be a shortened Picatinny or Weaver rail.

Figure 3:
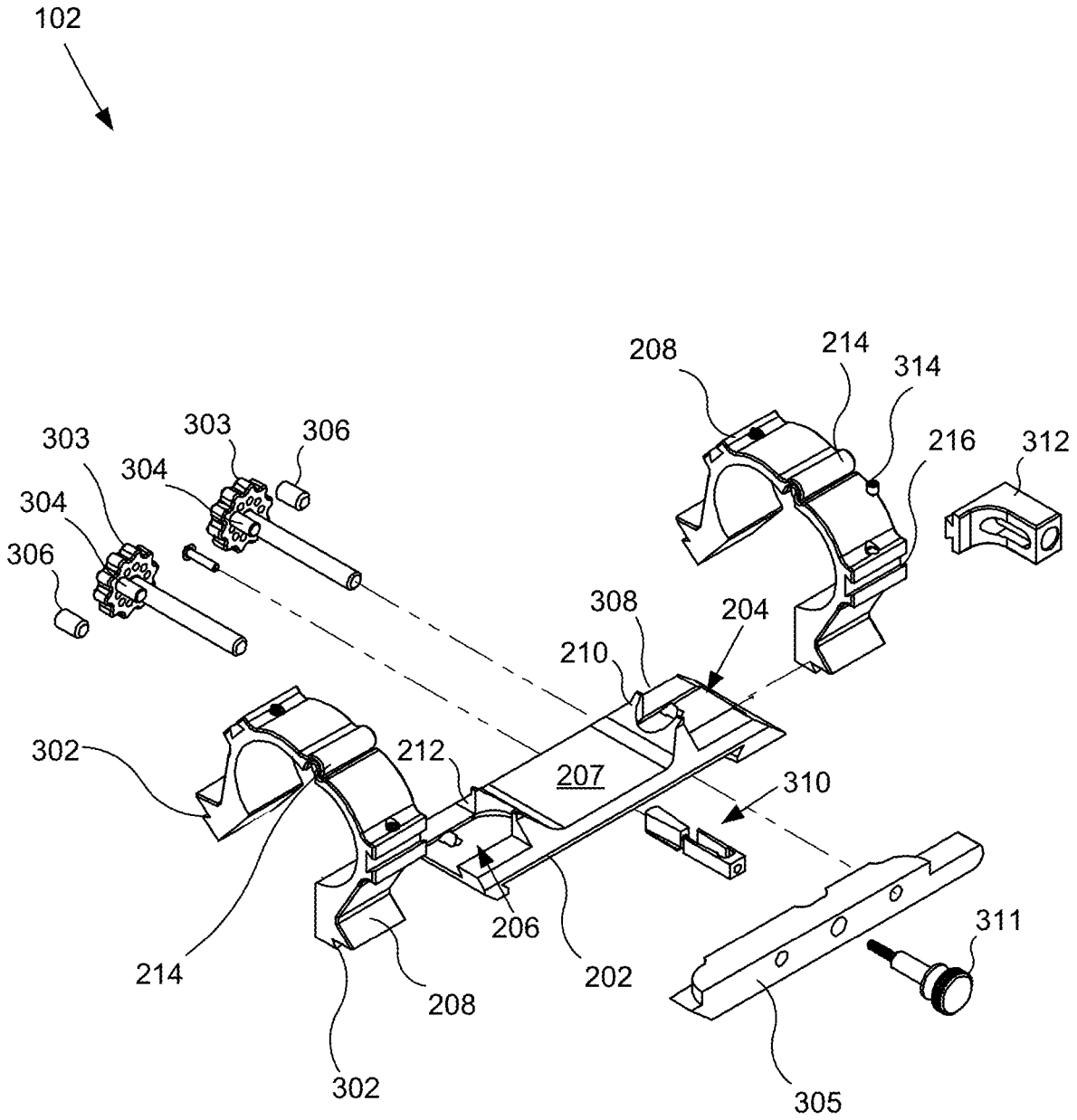
FIG. 3 is an exploded view diagram of the scope mounting system, according to examples of the current disclosure.

FIG. 3 is an exploded view diagram of the scope mounting system 102, according to examples of the current disclosure. In the depicted example the hinged scope rings 208 are illustrated in an open position. Each hinged scope ring 208 is formed of two halves that are coupled at the top by the top hinge 214. The top hinge 214 may be oriented longitudinally along the length of the barrel, or in other words, parallel with the bore axis 108. Each half of the hinged scope ring 208 includes at least one sloped surface 302 for engaging the one of the dovetail slots 204, 206 of the base. In other words, the base 202 is formed with elongated dovetail slots (e.g., forward dovetail slot 204 or rearward dovetail slot 206) that are inverted dovetails into which the sloped surfaces 302 of the hinged scope rings slide and securely lock into place.

The base, in certain examples, is configured to engage the undercuts of the rail 103, as will be described in greater detail below with reference to FIG. 8. This, beneficially, provides a downward clamping force instead of claiming the sides of the picatinny rail, as do many other scope mounts.

Lobed mounting dials 303, in certain examples, are provided with a ball detent 304. This beneficially provides a consistent and repeatable locking force to the base. Each of the lobed mounting dials is configured to pass through one side of the base to a locking bar 305. Stated differently, each of the lobed mounting dials passes through a first side of the base, through a cross-slot in the rail 103 and into the locking bar 305.

In certain examples, a single fastener 306 is used to secure the hinged scope ring 208 within either of the dovetail slots 204, 206. The fastener 306 may be a set screw that passes through an opening 308 in the base 202 to engage a side of the hinged scope ring 208. In certain examples, the fastener 306 is a dog-nosed screw that beneficially prevents over-tightening the hinged scope ring 208 and damaging the scope 105. A recess having a shape corresponding to an end of the fastener 306 may be formed in the side of the hinged scope ring 208 (see FIG. 4*c*).

In certain examples, disposed between the lobed mounting dials 303 is a wedge mechanism 310 that is configured to secure the base longitudinally. Previously, scope mounts relied on fastening pins that pass through the cross-slots to prevent longitudinal movement. However, the fastening pins are smaller than a width of the cross-slot, and therefore fail to prevent longitudinal movement of the scope mount. Conversely, the wedge mechanism 310 is configured to engage both sides of a cross-slot and prevent forward and rearward movement of the scope mounting system 102. The wedge mechanism 310 will be described in greater detail below. A wedge fastener 311 engages the wedge mechanism 310 and causes it to spread and engage the sides of the cross-slots of the rail 103. The wedge fastener 311 is also configured to engage the locking bar 305.

Also depicted in FIG. 3 is an accessory 312 attached to the accessory mounting interface 216. In certain examples, the accessory mounting interface 216 includes an inverted dovetail configuration for receiving a dovetail of the accessory 312. One example of an accessory that may be mountable to the side of the hinged scope ring 208 is an iron sight. A single set screw 314, in certain examples, secures the accessory 312 to the hinged scope ring 208. Accessory mounting interfaces may be positioned on each side of both the front and rear hinged scope rings.

Figure 4A:
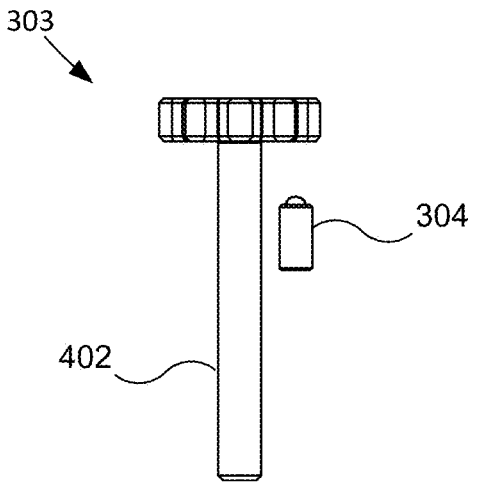
FIG. 4*a* is a side view diagram of a lobed mounting dial, in accordance with examples of the subject disclosure.

FIG. 4*a* is a side view diagram of a lobed mounting dial 303, in accordance with examples of the subject disclosure. The lobed mounting dial 303 is configured with an elongated shaft 402 to pass through the base 202 and engage an opening in the locking bar 305. The elongated shaft 402 may be hollow with internal threads that engage the locking bar 305 (also referred to as a locking plate). Alternatively, the elongated shaft 402 is formed with external threads that engage a threaded opening formed in the locking bar 305.

The lobed mounting dial 303 is "lobed" for ease of use and to encourage a user to fasten the scope mounting system 102 with his or her fingers. This beneficially prevents a user from over-tightening the scope mounting system 102. However, it is contemplated that any suitable fastener may be used. Also depicted is a ball detent 304. Beneficially, the ball detent 304 allows a user to apply a consistent amount of torque each time the scope mounting system 102 is positioned by indexing the lobed mounting dial 303 to the same position. For example, a user may turn the lobed mounting dial 303 a quantity of 10 positioning clicks each time.

Figure 4C:
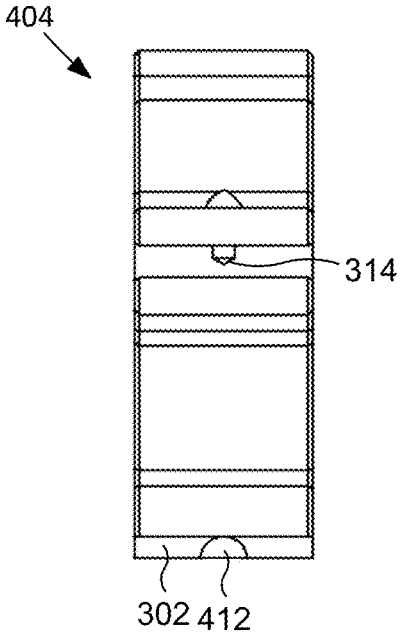
FIG. 4*c* is a side view diagram of the first half of the hinged scope ring, in accordance with examples of the subject disclosure.
Figure 4B:
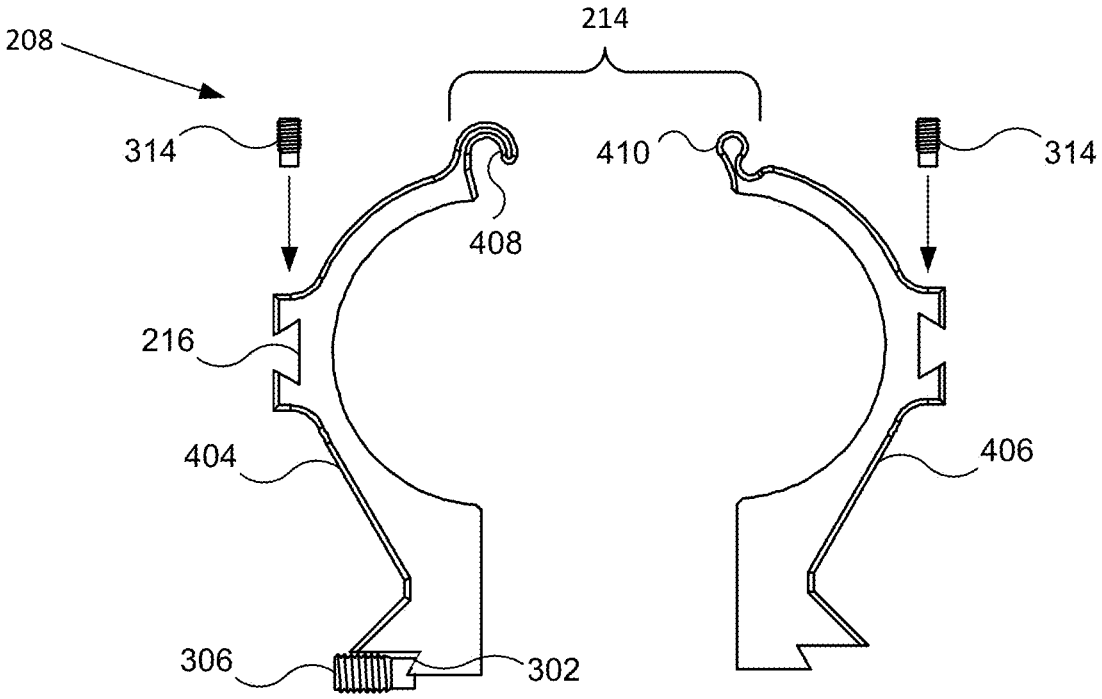
FIG. 4*b* is a rear view diagram of a hinged scope ring, according to examples of the subject disclosure.

FIG. 4*b* is a rear view diagram of a hinged scope ring 208, according to examples of the subject disclosure. The hinged scope ring 208, as described above, is formed of two halves 404, 406 that may be separable to aid in the mounting of a scope 105. The top hinge mechanism 214 may be formed at the top of each half 404, 406 of the ring. Stated differently, a first portion 408 of the hinge mechanism 214 may be formed on the first half 404, and a second portion 410 of the hinge mechanism 214 may be formed on the second half 406. In certain examples, the first portion 408 of the top hinge mechanism 214 is a knuckle or barrel portion that is configured to partially surround and pivotally engage the second portion 410 or pin. Although the depicted examples depict a type of hinge that is frequently referred to as a continuous, hurricane, or piano hinge, it is contemplated that other types of hinges may be adapted for use with the hinged scope ring 208. Examples of suitable hinges include, but are not limited to, lift-off hinges, pin hinges, barrel hinges, etc.

Also shown here is the fastener 306 for securing the hinged scope ring 208 within one of the dovetail slots 204, 206. The fastener 306, in certain examples, is a type of dog point set screw. The fastener 306 may be a full- or half-dog set screw with a protruding tip that is configured to lock inside of an opening in the base 202. The end, or "dog-nose" is configured to engage a flat (see FIG. 4*c*) formed in the sloped surface 302 (i.e., dovetail) of the first half 404 of the hinged scope ring 208. This, beneficially, ensures that each time a scope 105 is mounted, the same amount of clamping force is applied to the scope 105 and the scope 105 is not damaged because the fastener 306 "bottoms out" against the flat surface formed in the sloped surface 302.

FIG. 4*c* is a side view diagram of the first half 404 of the hinged scope ring 208, in accordance with examples of the subject disclosure. The first half 404 of the hinged scope ring 208 includes, as discussed above, a flat surface 412 formed in the sloped surface 302. The flat surface 412 is positioned to correspond with an opening in the base 202 so that the fastener 306 may pass through the opening and engage the flat surface 412, thereby securing the hinged scope ring 208 in the respective dovetail slot 204, 206. The flat surface 412 may be referred to a vertical surface in the sense that it is oriented perpendicular to an axis of the fastener 306.

Figure 5:
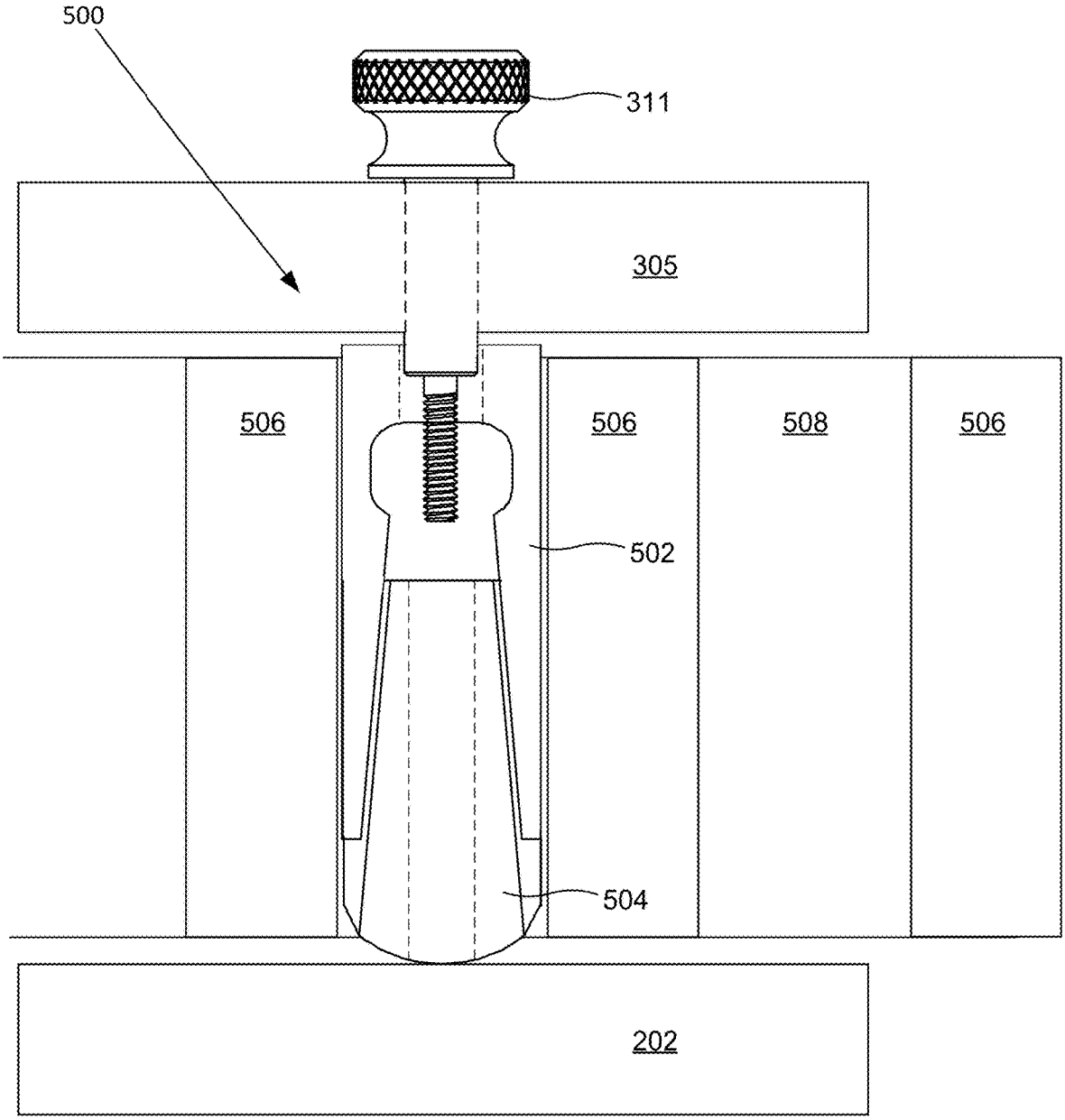
FIG. 5 is a top view diagram illustrating one example of the wedge mechanism in accordance with examples of the subject disclosure.
Figure 6:
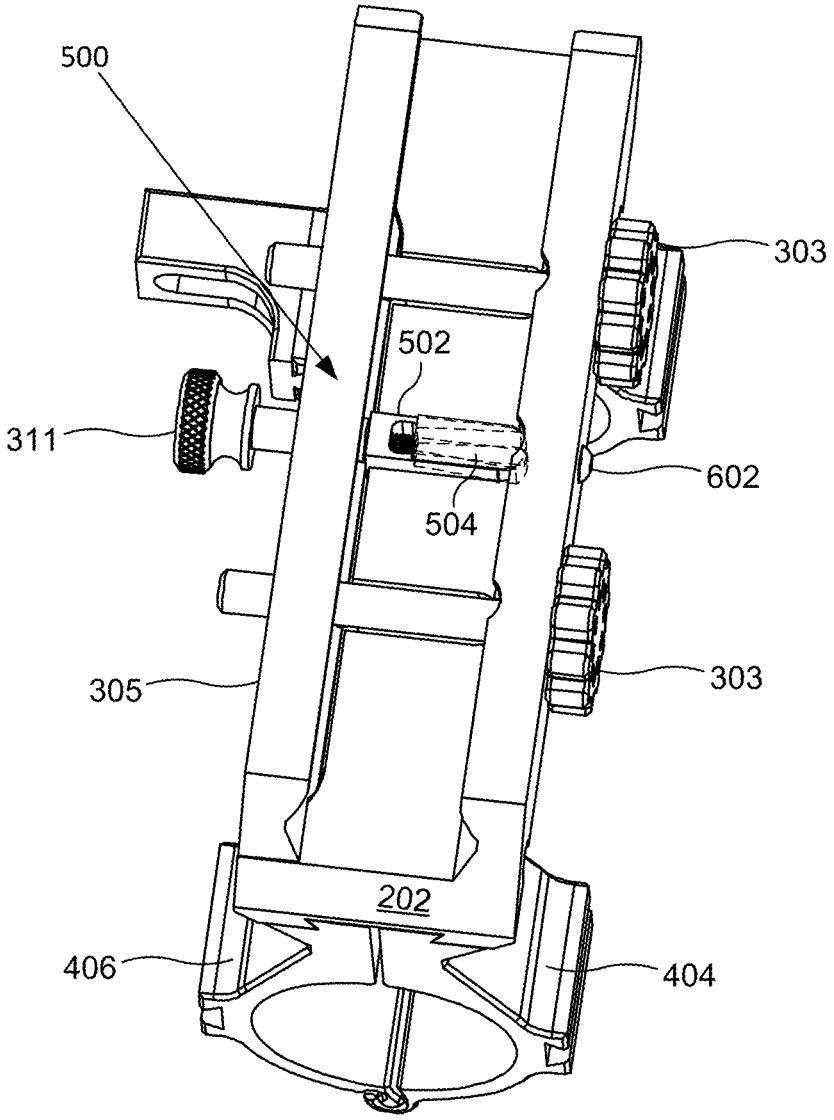
FIG. 6 is a bottom perspective view diagram illustrating one example of the wedge mechanism in accordance with examples of the subject disclosure.

Referring now to FIGS. 5 and 6, shown here are examples of the wedge mechanism 310 in different views. FIG. 5 is a top view diagram illustrating one example of the wedge mechanism in accordance with examples of the subject disclosure, while FIG. 6 is a bottom perspective view. The wedge mechanism 500, in certain examples, includes the wedge fastener 311, a wedge receiver 502 and a wedge 504. The wedge 504 is secured to the base 202 and configured with a threaded opening for receiving a threaded end of the wedge fastener 311. In certain examples, the wedge 504 is secured to the base 202 with a fastener 602 (see FIG. 6). The wedge receiver 502 may be secured to the locking bar 305.

In certain examples, the wedge 504 and the wedge receiver 502 are configured and dimensioned to be positioned between raised portions 506 of the rail 103. Cross-slots 508, or grooves, are formed between the raised portions 506. Side walls, formed by the transition between a raised portion 506 and a cross-slot 508, engage sides of the wedge receiver 502. As a user tightens the wedge fastener 311, the wedge 504 is drawn into the wedge receiver 502 which causes the sides of the wedge receiver 502 to spread and apply a force to the sides of the cross-slot 508 (i.e., the transition between the cross-slot 508 and the raised portion 506). This beneficially eliminates forward and rearward movement of the mounting system 102. Additionally, it is now possible to exactly position the mounting system 102 in the same longitudinal position, with reference to the rail, every time the mounting system 102 is mounted to the firearm 100. Previous mounting systems are unable to achieve this repeatability because of the ability of a fastener to move forward and backward within a cross-slot 508.

Another benefit of the wedge mechanism 500 is "cross-tensioning" created by the wedge fastener 311 and the lobed mounting dials 303. In other words, the wedge fastener 311 is pulling in one direction and the lobed mounting dials 303 are pulling in an opposite direction to create the cross-tension. Additionally, this cross-tensioning eliminates the need for a thread adhesive.

Figure 7:
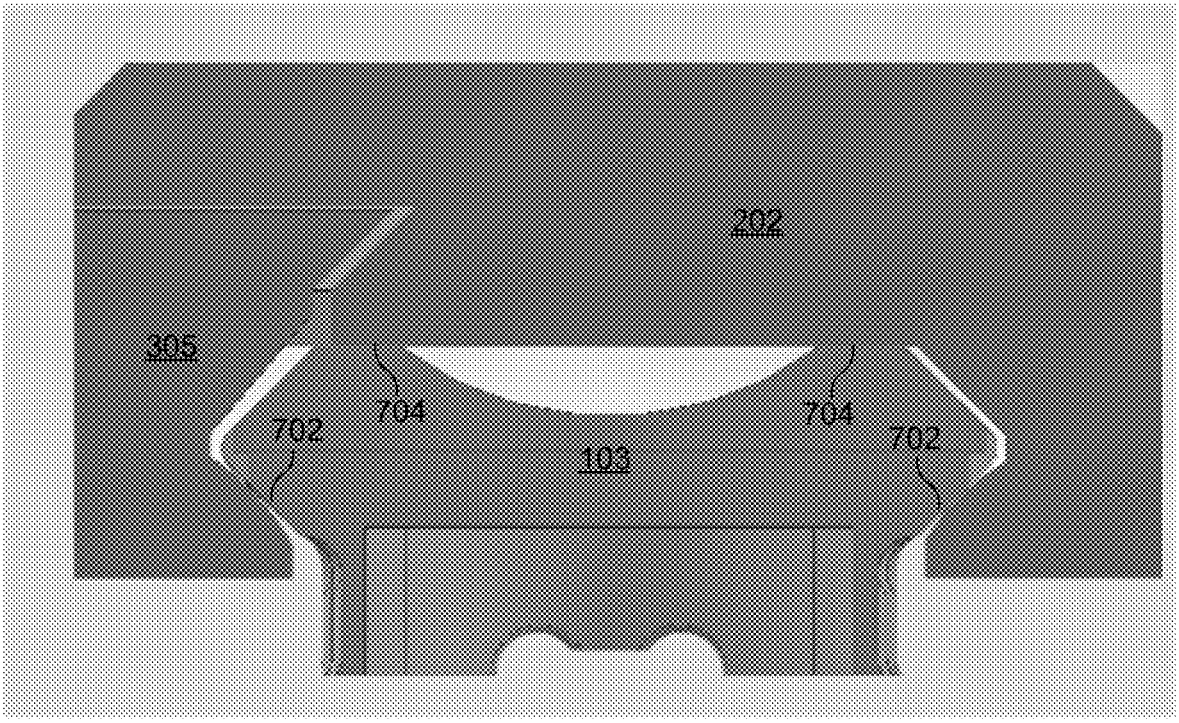
FIG. 7 is a cross-sectional diagram illustrating examples of the base engaging the rail system, according to examples of the subject disclosure.

FIG. 7 is a cross-sectional diagram illustrating examples of the base 202 engaging the rail system 103, according to examples of the subject disclosure. The base 202 is configured to engage undercut surfaces 702 of the rail, as depicted, instead of the sides. Previous mounting systems generally rely on a clamping force on the sides of the rail 103, but this is problematic because variances in rail width vary. However, the undercut angle and width of the base of the rail are held to higher tolerances. Beneficially, the mounting system 102 primarily engages the undercut surfaces 702 and the top surfaces 704 of the rail system instead of the sides. This creates a wedging action that pulls the mounting system 102 down onto the rail 103. To aid in this, the cross-sectional profiles of the base 202 and locking bar 305 are configured to engage the undercut surface 702 and the top surface 704 while not engaging the sides or outer tips of the rail 103.

Figure 8:
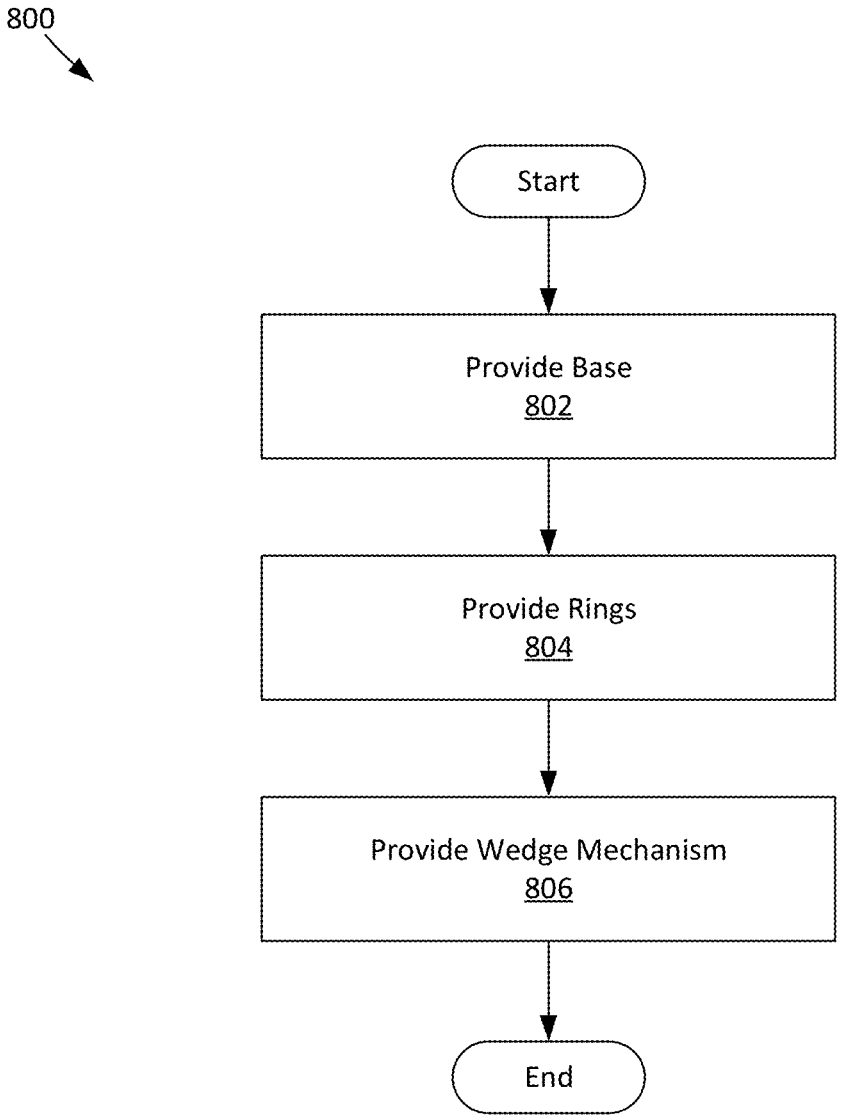
FIG. 8 is a schematic flowchart diagram illustrating an example of providing an improved trigger mechanism, according to examples of the subject disclosure.

FIG. 8 is a schematic flowchart diagram illustrating an example of providing an improved trigger mechanism, according to examples of the subject disclosure. The method 800, at block, includes providing a base. In certain examples, the base is provided as described above with reference to FIGS. 2-7, including forward and rearward dovetail slots. At block 804, the method 800 includes providing at least one hinged scope ring. The hinged scope ring may be provided with sloped surfaces for engaging the dovetail slots of the base. At block 806, the method 800 includes providing a wedge mechanism. In certain examples, the wedge mechanism is provided as described above with respect to FIGS. 2-8.

Figure 9A:
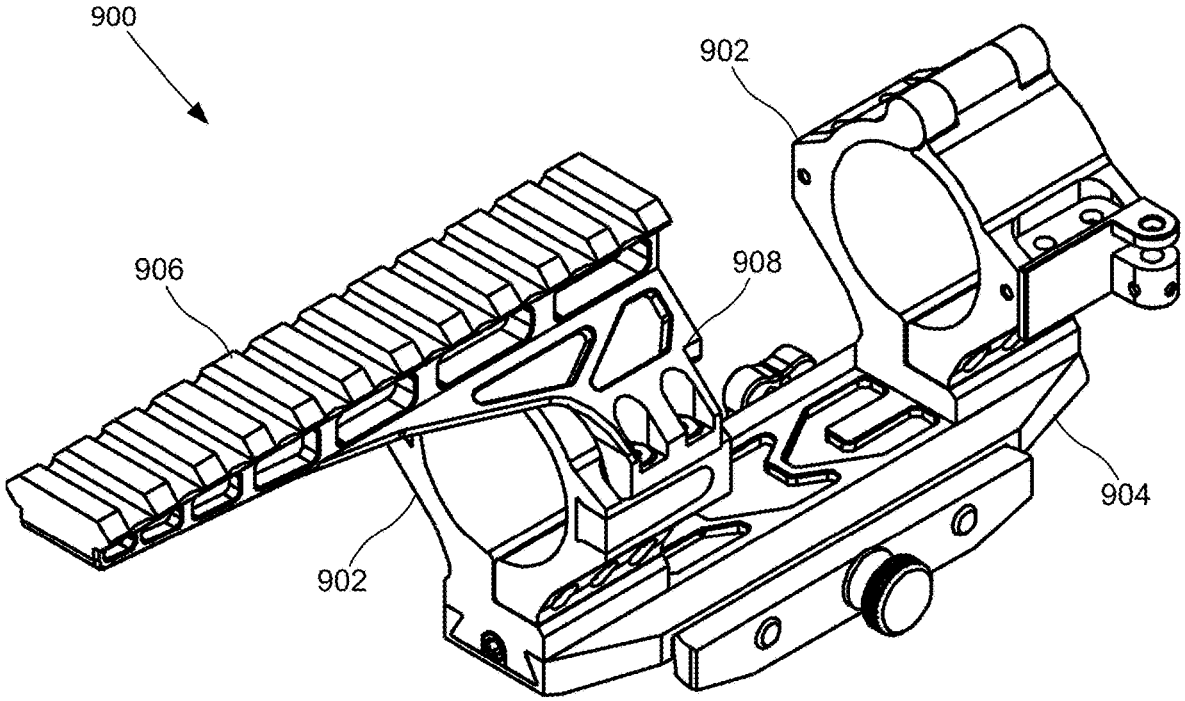
FIGS. 9*a* and 9*b* are perspective and side view diagrams, respectively, that illustrate examples of a scope mounting system in accordance with examples of the subject disclosure.
Figure 9B:
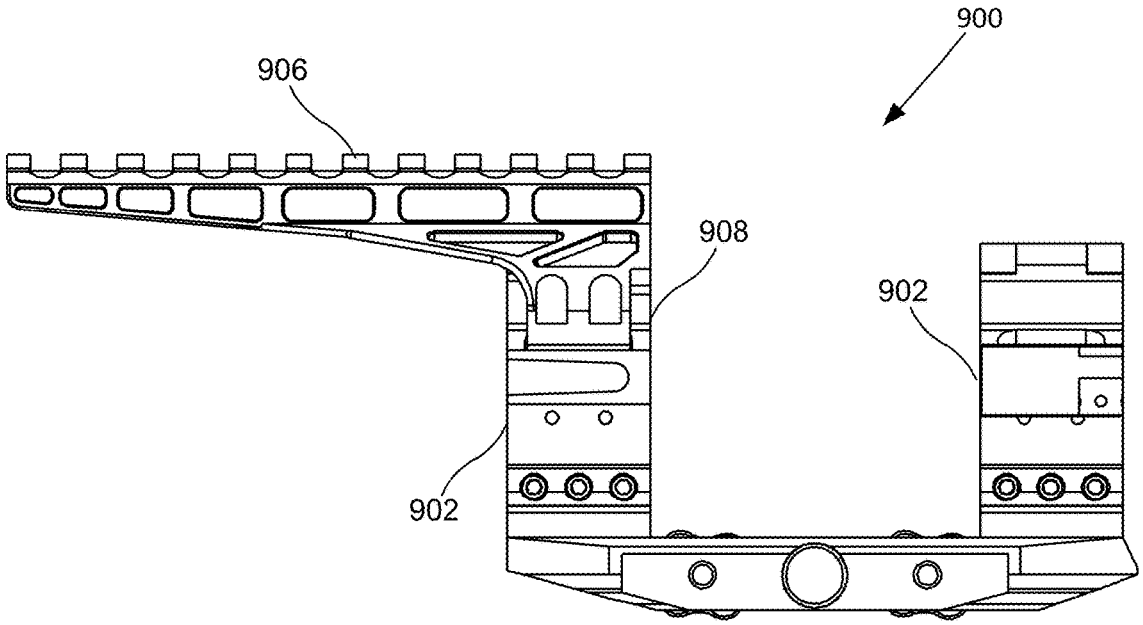

FIGS. 9*a* and 9*b* are perspective and side view diagrams, respectively, that illustrate examples of a scope mounting system 900 in accordance with examples of the subject disclosure. The scope mounting system 900 functions in a manner similar to that described above with respect to FIGS. 1-8 and includes one or more scope rings 902 that are coupled with the base 904. In certain examples, the base 904 may be configured without front or rear ring abutments (see FIG. 2). Instead of front or rear ring abutments to aid in the correct positioning of the scope rings 902, the base 904 may utilize a dovetail slot with converging sides, as will be explained in greater detail below with respect to FIGS. 10 and 11.

As discussed above, the scope mount systems of this disclosure are configured and adaptable to receive different accessories (see e.g., FIG. 3). In the examples depicted in FIGS. 9*a* and 9*b*, the scope rings 902 are configured to receive an accessory rail 906. The accessory rail 906 is configured with legs 908 that span from one side of the scope ring 902 to the other. The legs 908 may be fastened to mounting surfaces of either scope ring 902.

Figure 10:
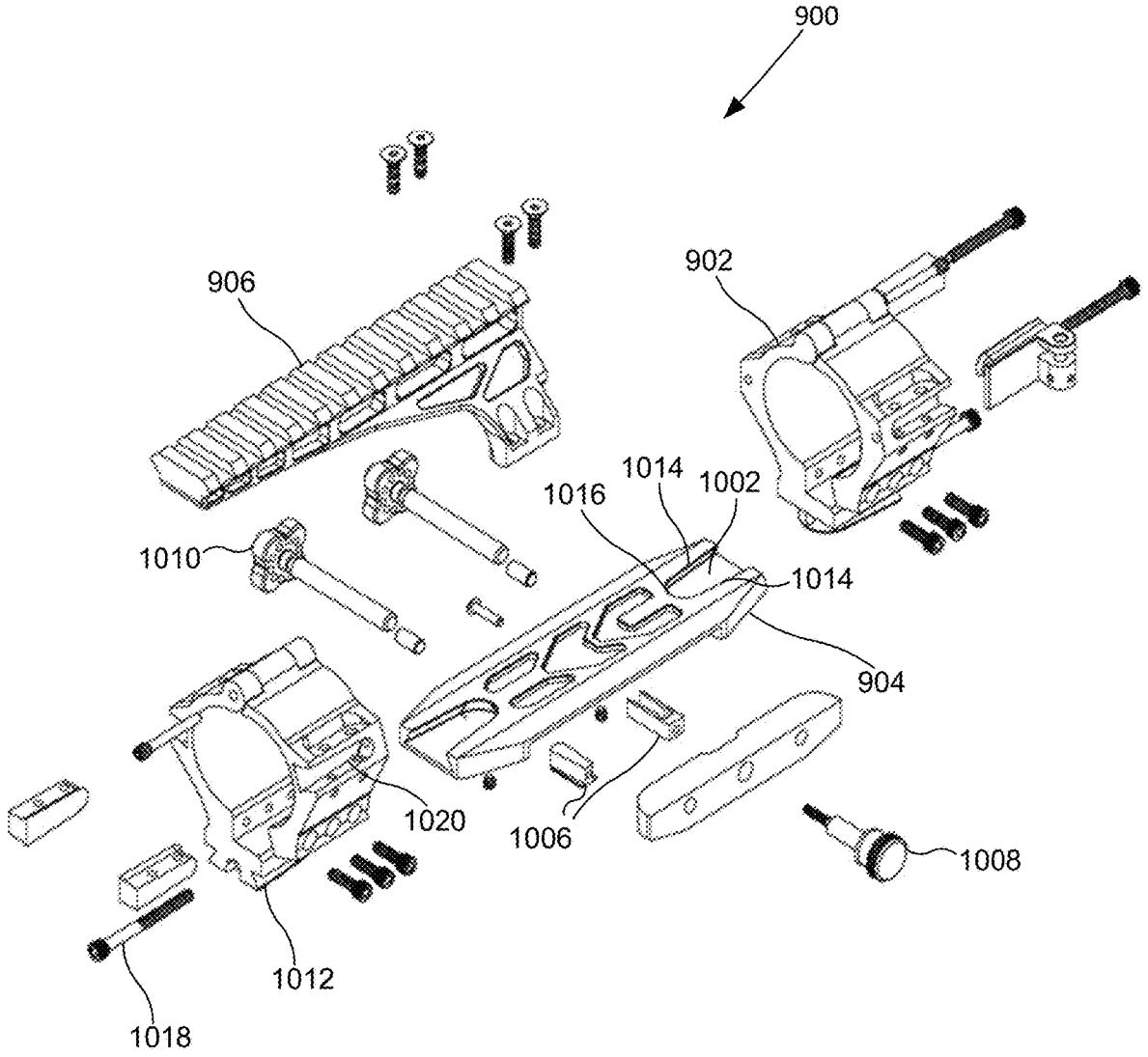
FIG. 10 is an exploded view diagram illustrating the scope mount system, in accordance with examples of the subject disclosure.

FIG. 10 is an exploded view diagram illustrating the scope mount system 900, in accordance with examples of the subject disclosure. The scope mount system 900, as described above with reference to FIGS. 9*a* and 9*b*, utilizes many components similar to those described above with reference to FIGS. 1-8, including but not limited to, scope rings 902, the base 904, dovetail slots 1002, a locking bar 1004, a wedge mechanism 1006, a wedge fastener 1008, lobed mounting dials 1010, and various fasteners.

In certain examples, the scope mount system 900 is configured with one or more dovetail slots 1002. Each dovetail slot 1002 is configured to receive a dovetail 1012 of a scope ring 902. In certain examples, the dovetail slot 1002 is configured with a parabolic shape as depicted. Stated differently, the dovetail slot 1002 may have converging side portions 1014 that extend from an opening (that receives the scope ring 902) to a vertex 1016 or point. The converging side portions 1014 beneficially cause the scope ring 902 to perfectly and repeatedly align and position the scope ring 902 with the base 904. Although a generally parabolic shape is depicted, other shapes are contemplated that include converging side portions 1014.

Another benefit of the depicted dovetail slot 1002 is the alignment and position of the scope ring no longer relies on an abutment, thereby reducing the mass of the base 904. A fastener 1018 disposed along a centerline of the base 904 may be used to secure the scope ring 902 to the base 904. The fastener 1018 may, in certain examples, pass through an opening in the dovetail 1012 of the scope ring 902 and engage a threaded opening disposed in the dovetail slot 1002 at the vertex 1016. Similarly shaped dovetail slots 1020 may be formed in the scope rings 902 for attaching various accessories.

Figure 11:
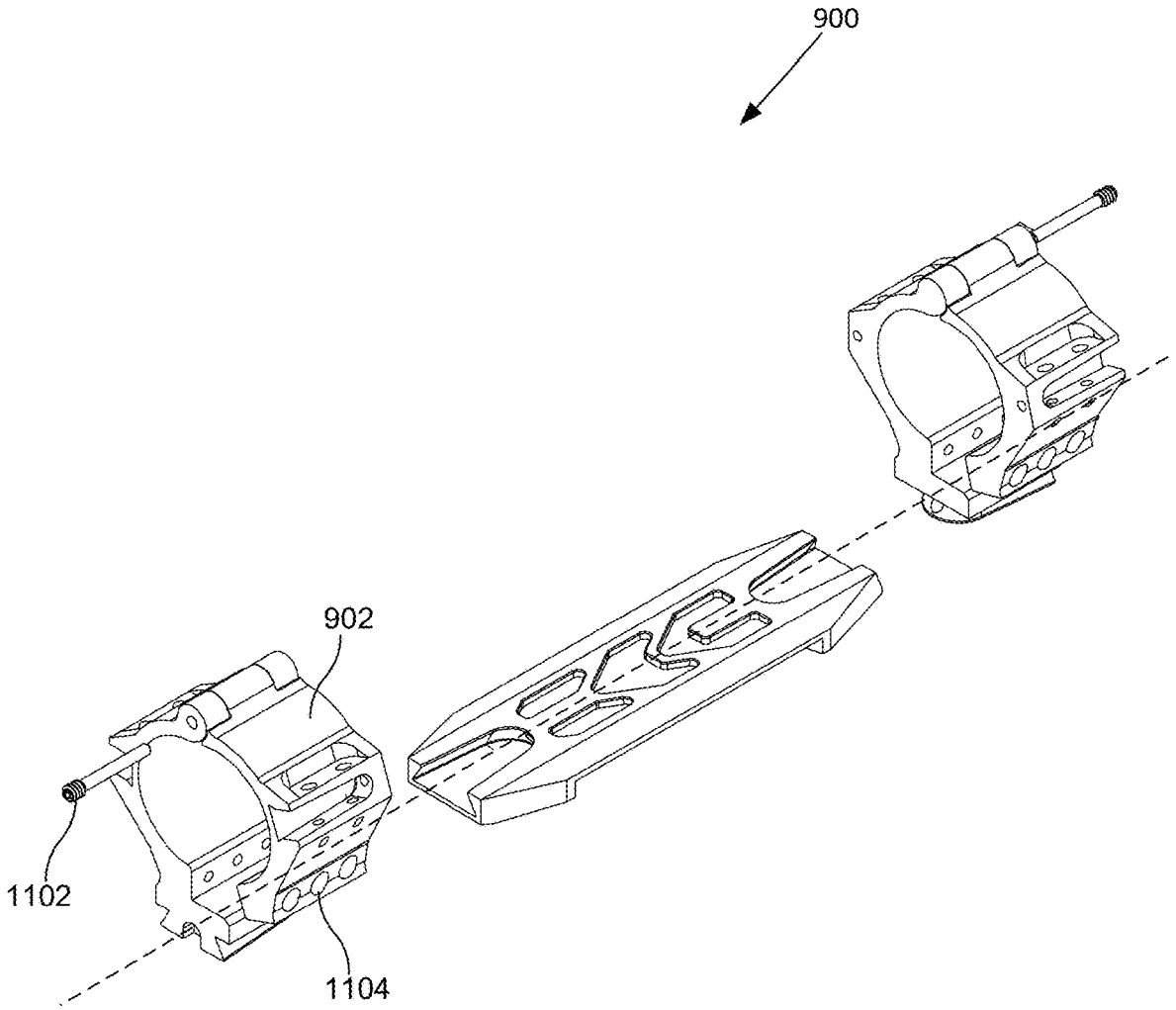
FIG. 11 is a simplified exploded view diagram of the scope mount system in accordance with examples of the subject disclosure.

FIG. 11 is a simplified exploded view diagram of the scope mount system 900 in accordance with examples of the subject disclosure. Depicted here are scope rings 902 and the base 904. Instead of the continuous hinge style described above with reference to FIGS. 1-8, a pin hinge 1102 may be used to hingedly connect the two halves of the scope ring 902 to each other. The pin hinge 1102, in certain examples, is disposed substantially parallel with lengthwise axis of the base 904. In other words, the pin hinge 1102 is longitudinally oriented with respect to the base 904. Fasteners (see FIG. 10), disposed laterally (i.e., transverse to a lengthwise axis) may pass through openings 1104 in one half of the scope ring 902 to secure the two halves of the scope rings 902 together.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A base for securing a scope mounting system to a firearm rail, the base comprising:

a first dovetail slot extending from a first end of the base to a first ring abutment, where the first dovetail slot is disposed on a top surface of the base;

a second dovetail slot extending from a second end of the base to a second ring abutment; and a wedge mechanism coupled to a bottom surface of the base and configured to engage side surfaces of a groove formed in the firearm rail.

2. The base of claim 1, where the scope mounting system further comprises a first scope ring configured to detachably couple a scope to the base, where the first scope ring includes at least one sloped surface configured to engage the first dovetail slot.

3. The base of claim 2, where the first scope ring comprises a first half and a second half and where the first half is pivotally coupled with the second half at a top hinge.

4. The base of claim 2, where the first scope ring comprises at least one accessory mounting surface.

5. The base of claim 2, where the scope mounting system further comprises a second scope ring configured to detachably couple the scope to the base, where the second scope ring includes at least one sloped surface configured to engage the second dovetail slot.

6. The base of claim 2, further comprising a fastener configured to pass through an opening in the side surface of the base and engage a vertical surface formed in the sloped surface.

7. The base of claim 1, where the base comprises a side surface configured to engage a first undercut surface of the rail system, and a locking bar disposed opposite the side surface and configured to engage a second undercut surface of the rail system.

8. The base of claim 7 where the wedge mechanism comprises:

a wedge receiver;

a wedge coupled to the side surface; and a wedge fastener.

9. The base of claim 8, where the wedge fastener is configured to pass through the locking bar and the wedge receiver and into an opening in the wedge, and where tightening the wedge fastener causes the wedge to be drawn into and spread open the wedge receiver.

10. The base of claim 1, further comprising at least one fastening dial configured to secure a locking bar to the base.

11. The base of claim 10, where the at least one fastening dial comprises a ball detent for indicating a plurality of tightening positions.

12. A scope mounting system for coupling a scope to a firearm rail, comprising:

a base comprising:

a first dovetail slot extending from a first end of the base to a first ring abutment;

a second dovetail slot extending from a second end of the base to a second ring abutment; and a wedge mechanism coupled to the base and configured to engage side surfaces of a groove formed in the firearm rail;

a first scope ring configured to couple the scope to the base, where the first scope ring includes at least one sloped surface configured to engage the first dovetail slot; and a second scope ring configured to couple the scope to the base, where the second scope ring includes at least one sloped surface configured to engage the second dovetail slot.

13. The scope mounting system of claim 12, where the first scope ring comprises a first half and a second half and where the first half is pivotally coupled with the second half at a top hinge.

14. The scope mounting system of claim 13, where the first scope ring comprises at least one accessory mounting surface.

15. The scope mounting system of claim 13, further comprising a fastener configured to pass through an opening in the side surface of the base and engage a vertical surface formed in the sloped surface of either the first scope ring or the second scope ring.

16. The scope mounting system of claim 12, where the base comprises a side surface configured to engage a first undercut surface of the rail system, and a locking bar disposed opposite the side surface and configured to engage a second undercut surface of the rail system.

17. The scope mounting system of claim 12, where the wedge mechanism comprises:

a wedge receiver;

a wedge coupled to the side surface; and a wedge fastener.

18. The scope mounting system of claim 17, where the wedge fastener is configured to pass through a locking bar and the wedge receiver and into an opening in the wedge, and where tightening the wedge fastener causes the wedge to be drawn into and spread open the wedge receiver.

19. The scope mounting system of claim 18, further comprising at least one fastening dial configured to secure the locking bar to the base.

20. A method comprising:

providing a base comprising:

a first dovetail slot extending from a first end of the base to a first ring abutment;

a second dovetail slot extending from a second end of the base to a second ring abutment; and a wedge mechanism coupled to the base and configured to engage side surfaces of a groove formed in a firearm rail;

providing a first scope ring configured to couple a scope to the base, where the first scope ring includes at least one sloped surface configured to engage the first dovetail slot; and providing a second scope ring configured to couple the scope to the base, where the second scope ring includes at least one sloped surface configured to engage the second dovetail slot.

* * * * *